United States Patent [19]

Rhodes

[11] Patent Number: 4,479,534

[45] Date of Patent: Oct. 30, 1984

[54] TRANSPARENT RADIATION RECUPERATOR

[75] Inventor: Robin B. Rhodes, Wellsville, N.Y.

[73] Assignee: The Air Preheater Company, Inc., Wellsville, N.Y.

[21] Appl. No.: 328,054

[22] Filed: Dec. 7, 1981

[51] Int. Cl.[3] ..... F28D 7/12

[52] U.S. Cl. ..... 165/142; 165/DIG. 6; 165/DIG. 8

[58] Field of Search ..... 165/142, DIG. 6, DIG. 28; 126/443, 448, 91 A; 122/143, 180; 432/143

[56] References Cited

U.S. PATENT DOCUMENTS

| | | | |
|---|---|---|---|
| 2,670,945 | 3/1954 | Hazen | 432/143 |
| 2,937,855 | 5/1960 | Hazen | 165/142 |
| 3,586,098 | 6/1971 | Wellensiek | 165/142 |
| 4,048,983 | 9/1977 | Pei | 165/142 |
| 4,106,556 | 8/1978 | Heyn et al. | 165/142 |
| 4,304,222 | 12/1981 | Novinger | 126/443 |

FOREIGN PATENT DOCUMENTS

| | | | |
|---|---|---|---|
| 2908825 | 9/1979 | Fed. Rep. of Germany | 165/DIG. 6 |

*Primary Examiner*—William R. Cline
*Assistant Examiner*—John F. McNally
*Attorney, Agent, or Firm*—William W. Habelt

[57] ABSTRACT

A concentric tube type recuperative heat exchanger that includes an outer transparent tube 22 and an inner metallic tube 24 connected to suitable headers 12 and 14. The outer tube 24 is closed at the bottom end and open at the top end in order that cool air may be directed down through the open ended inner tube and up through the annular space therebetween where it may accept radiant energy transmitted through transparent tube 22. A tubular heat shield 36 of apertured metal lying in the annular space between tubes absorbs radiant heat passing directly through transparent tube 22 and that which is reflected from inner tube 24. Shield 36 serves simultaneously as a means for increasing the turbulence of fluid flowing through the annular space between tubes and as a heat sink that absorbs heat radiated between tube walls.

4 Claims, 3 Drawing Figures

TRANSPARENT RADIATION RECUPERATOR

BACKGROUND OF THE INVENTION

The present invention relates to an improved structure for a concentric tube type heat exchanger. Particularly, the invention relates to a concentric tube type recuperator having transparent outer tube walls to more effectively permit the transmission therethrough of radiant heat energy. The heat exchanger includes special heat absorbing material that is particularly positioned to absorb the radiant heat tranversing the transparent walls of the heat exchanger and transmit the abosorbed heat to cool air or other fluid flowing therethrough.

Recuperative heat exchange apparatus employing a series of concentric inner and outer tubes to transfer heat from hot exhaust gases to cool air to be used for combustion are well known in the heat exchange art. Examples of conventional heat exchangers of this type are to be found in U.S. Pat. No. 3,586,098 and U.S. Pat. No. 2,670,945 where a plurality of tubular heat exchangers are adapted to transmit heat from hot gas passing over the tubes to cool air flowing therethrough.

Typically, hot exhaust gases are admitted to the heat exchanger and then directed over the heat exchanger tubes while cool air to be heated is directed through annular passageways between the concentric tubes. A portion of the heat carried by the hot exhaust gas is then transmitted through the wall of the outer tube to the cool air flowing through the annular passageway between concentric tubes. As the outer tube is heated by the hot gas passing over it, heat is also radiated from the inner surface thereof to the inner tube which upon becoming heated, also transfers this heat to the cool air flowing thereby.

Present limits to the use of such apparatus are determined largely by the high temperature of the gases to which the tubes are exposed and this by corrosiveness of the gas to which the tubes are exposed. Therefore any measures to overcome these limitations must include increasing the heat resistance or the corrosion resistance of the tubes.

SUMMARY OF THE INVENTION

The present invention accordingly relates to a concentric tube type heat exchanger wherein the outer tube thereof is comprised of fused quartz, silica glass, or other corrosion resistant material that is essentially transparent to the passage therethrough of radiant heat energy. The outer transparent tube is closed at the bottom and open at the top, with the top having access to a hot air manifold. Within the transparent tube and concentric thereto there is an open ended metallic tube connected at its upper end to a cold air inlet header whereby cold air may flow from the cold air source down through the inner metallic tube and up through the annular space between the inner and outer tubes to the hot air header, where the then heated air may flow to its place of intended use.

Additionally, an aperture heat shield is disposed in the annular space between the inner and outer tubes. The heat shield absorbs heat radiated by the hot fluid through the transparent outer tube as well as heat reradiated from the metallic inner tube. The heat shield transfers its absorbed heat by convention to the cool fluid flowing through the annular space between the inner and outer tubes. In this manner, heat transfer between the hot and cold fluids is greatly enhanced.

DESCRIPTION OF THE PREFERRED EMBODIMENT

Figure 1:
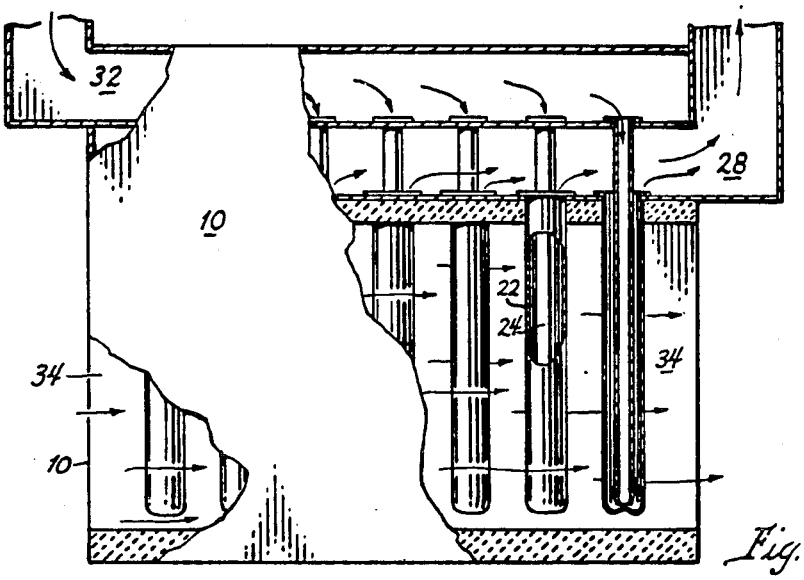
FIG. 1 is a side elevation view, partly in section, of a concentric tube type heat exchanger having a multiple number of concentric tubes.
Figure 2:
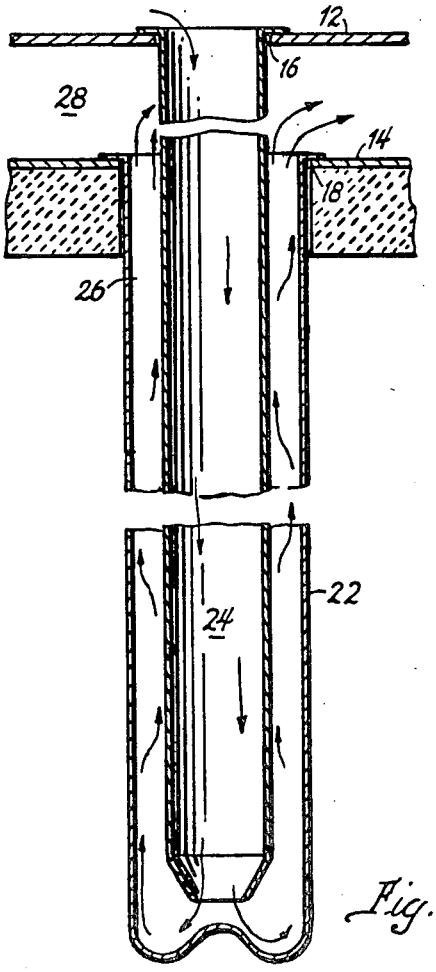
FIG. 2 is an enlarged cross-sectional view of a single concentric tube recuperator.
Figure 3:
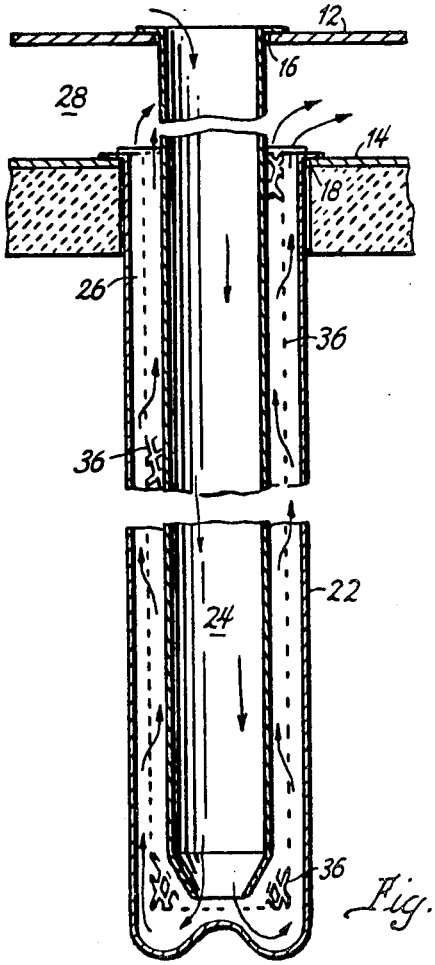
FIG. 3 is an enlarged cross-sectional view of a single concentric tube recuperator according to the present invention.

Referring now to the drawing, the numeral 10 designates the side walls that enclose a recuperator chamber 34. Supported on the walls 10 are a plurality of spaced plates 12–14 with concentric openings 16–18 therein to comprise header plates from which banks of tubes 22–24 depend. The outer tubes 22 depend from the lower header 14 while the inner tubes 24 depend from the upper header 12 whereby there is formed therebetween an annular space 26 that is open at the upper end to the chamber 28 lying between plates 12 and 14, while the central tube is open to the chamber 32 above plate 12.

The outer tube 22 is closed at the bottom and open at the top end while the inner tube 24 is open at both ends thereof to permit cold air from an outside source to enter chamber 32 above plate 12, flow into tube 24 and descend therethrough, rise through annular space 26, and then be discharged through outlet chamber 28. Hot gas flowing through chamber 34 flows over the outside of the tubes 24 to transmit heat to the cold air flowing through the tubes. As the side walls of housing 10 become heated by the hot gases of chamber 34, said walls, and also the hot gas, will radiate heat directly to the tubes 22.

According to the present invention, the outer tubes 22 are comprised of temperature resistant glass, quartz, pyrex or other transparent material capable of withstanding high temperatures that range in excess of 1600° F. Because the outer tubes are transparent, the transmission of radiant energy therethrough is enhanced. Heat radiated by the hot gas and hot walls of the housing 10 traverses each transparent tube 2 and passes directly inward to tube 24 that is comprised of the usual heat absorbing metallic material. Upon becoming heated, tube 24 in turn transmits some heat to the cold air flowing down through tube 24, and some to the fluid passing upward through annular space 26.

Further in accordance with the present invention, there is suspended between the outer tube 22 and the inner tube 24 an open-ended tube-like heat shield 36 of expanded metal, screen, or other apertured heat absorbing material. This arrangement, permits some radiant energy to pass directly through the apertures thereof to the inner tube 24, while some radiant energy is absorbed directly by the apertured heat shield. As cool air from chamber 32 passes down through tube 24, it picks up some of the heat radiated to the walls of the tube 24 through the apertures of the tube-like shield 36. Upon reaching the bottom of tube 22 the cool air is reversed and caused to flow over the outside of inner tube 24 and over both sides of apertured tube-like shield 36.

In flowing up through the annular space between tubes 22 and 24 the cool air or other fluid to be heated accordingly flows in intimate contact with the concentric inner and outer tube walls and with both sides of the apertured heat shield 36. Moreover, the heat shield 36 serves to increase the turbulence of fluid flowing through the annular space between tubes so the effectiveness of the heat transfer between heated tube surfaces and the cool fluid is further increased.

As a result of this arrangement the heat transfer effectivenes of the device is greatly enhanced. Therefore the surfaces of the heat exchanger may be operated at a reduced temperature whereby temperature flows may be increased upward to 3000° F. Moreover, because of the increased effectiveness of such a device, the heat exchanger may be made smaller or it may be made to include fewer modules or units.

I claim:

1. A recuperative heat exchange apparatus for transferring heat from a hot radiating gas to cold gas to be heated comprising:

a. a housing defining a chamber for the flow of the hot radiating gas therethrough;

b. a radiation-transparent outer tube extending into the chamber of said housing, said radiation-transparent outer tube being closed at one end open at the opposite end and comprised of a heat resistant material capable of withstanding temperature in excess of 1600° F.;

c. an outlet header connecting the open end of said radiation-transparent outer tube to a passageway for discharging the gas heated in the heat exchange apparatus;

d. an open ended metallic radiation-absorbing inner tube concentrically disposed within said outer tube so as to define an annular space therebetween and spaced from the closed end of said outer tube so as to permit gas flow from said inner tube into the annular space between said radiation-transparent outer tube and said radiation-absorbing inner tube;

e. an inlet header connecting said inner tube to a supply of cold gas to be heated thereby establishing a continuous flow path for directing cold gas to be heated from said inlet header through said inner tube and thence through the annular space between said inner tube and said outer tube to said outlet header;

f. an apertured tubular radiation-absorbing shield disposed concentrically in the annular space in spaced relationship between said radiation-transparent outer tube and said radiation-absorbing inner tube whereby the gas flowing through the annular passage passes along both sides of and through the apertured tubular radiation-absorbing shield, said apertured shield adapted to absorb a first portion of the radiant heat passing through said radiation-transparent outer tube and transfer the absorbed heat to the gas passing through the annular space while simultaneously permitting a second portion of the radiant heat passing through said radiation-transparent outer tube to pass directly to the radiation-absorbing inner tube.

2. A concentric tube recuperator adapted to be exposed to both radiative and convective heat for transferring heat from a flow of a hot radiating gas to a cold gas to be heated, comprising:

a. a radiation-transparent outer tube of a heat resistant material capable of withstanding temperatures in excess of 1600° F., said outer tube being closed at one end and open at the opposite end, the closed end of said outer tube adapted to be disposed in a flow of hot radiating gas;

b. an open-ended metallic radiation-absorbing inner tube disposed concentrically within said radiation-transparent outer tube so as to define an annular space therebetween, one end thereof extending out of the open end of said outer tube and the other end thereof spaced from the closed end of said outer tube so as to permit gas flow through said inner tube thence into and through the annular space between said radiation-transparent outer tube and said radiation-absorbing inner tube; and c. an apertured tubular radiation-absorbing shield disposed concentrically in the annular space in spaced relationship between said radiation-transparent outer tube and said radiational-absorbing inner tube whereby the gas flowing through the annular passage passes along both sides of and through the apertured tubular radiation-absorbing shield, said apertured shield adapted to absorb a first portion of te radiant heat passing through said radiation-transparent outer tube and transfer the absorbed heat to the gas passing through the annular space while simultaneously permitting a second portion of the radiant heat passing through said radiation-transparent outer tube to pass directly to the radiation-absorbing inner tube.

3. A concentric tube type recuperator as defined in claim 2 wherein the outer tube is comprised of glass.

4. A concentric tube type recuperator as defined in claim 2 wherein the outer tube is comprised of fused quartz.

* * * * *